US008651399B2

(12) United States Patent
Wu

(10) Patent No.: US 8,651,399 B2
(45) Date of Patent: Feb. 18, 2014

(54) STRUCTURE FOR ADJUSTING SHOWERHEAD ANGLE

(75) Inventor: Shih-Piao Wu, Changhua (TW)

(73) Assignee: Jiin Haur Industrial Co. Ltd., Changhua (TW)

( * ) Notice: Subject to any disclaimer, the term of this patent is extended or adjusted under 35 U.S.C. 154(b) by 359 days.

(21) Appl. No.: 13/220,475

(22) Filed: Aug. 29, 2011

(65) Prior Publication Data

US 2013/0048753 A1 Feb. 28, 2013

(51) Int. Cl.
*B05B 15/06* (2006.01)

(52) U.S. Cl.
CPC ..... *B05B 15/061* (2013.01)
USPC ..... 239/283; 239/282; 239/200; 4/567; 4/570; 4/605; 4/615; 248/219.3; 248/219.4

(58) Field of Classification Search
CPC .... A01G 25/15; B05B 15/061; B05B 15/065; B05B 1/18; E03C 1/06; E03C 1/066; A47K 3/281; E04H 12/24; G09F 7/18; F16M 13/02
USPC ..... 239/200, 282, 283; 4/567, 570, 605, 4/615; 248/219.3, 219.4, 65, 74.4, 75, 248/219.1, 229.1, 229.14; 137/602, 605, 137/625.4, 625.47
See application file for complete search history.

(56) References Cited

U.S. PATENT DOCUMENTS 3,826,454 A * 7/1974 Zieger ..... 248/75
4,719,654 A * 1/1988 Blessing ..... 4/597
6,361,005 B1 * 3/2002 Faisst et al. ..... 248/219.4

* cited by examiner

*Primary Examiner* — Dinh Q Nguyen
(74) *Attorney, Agent, or Firm* — Che-Yang Chen; Law office of Michzel Chen

(57) ABSTRACT

A structure to hang a showerhead includes a fixed base and a supporting unit, wherein the supporting unit has two clamping arms and two conjugating arms, and one side of the clamping arms has a wedging surface that has two conjugating recessed arcs with an inclined angle corresponding to a mounting surface of the fixed base, and the inclined angle of one recessed arc is smaller than the other recessed arc. A conjugating surface extends from one end of the wedging surface, and engages with the other conjugating surface of the other clamping arm. An engaging surface is formed on the other side of the clamping arm to engage with the conjugating arms. According to this structure, the angle of the showerhead can be adjusted based on different inclined angles of the conjugating recessed arcs to further achieve the goal of easily adjusting the angle of water output from the showerhead.

5 Claims, 6 Drawing Sheets

STRUCTURE FOR ADJUSTING SHOWERHEAD ANGLE

FIELD OF THE INVENTION

The present invention is related to a showerhead disposition structure, and more specifically to a showerhead that can change its angle by engaging with a movable recessed arc to achieve the goal of easily adjusting the angle of the showerhead.

BACKGROUND OF THE INVENTION

In today's bathrooms and shower rooms, most people use a showerhead as shower equipment, and the showerhead is with a showerhead base set up at the wall to allow the user to hang the showerhead when taking a shower, so the user can use his/her hands to wash the body and enjoy the pleasure of the shower. Conventionally, the showerhead base has a conjugation base, one side of which is connected to the wall, and the other side recessedly forms a C-shaped engaging slot having an engaging arm on each side thereof to conjugate with the showerhead, so the showerhead can be hung on the wall. However, there is only a fixed angle for the showerhead to be hung on the wall, and the angle of water output from the showerhead cannot be adjusted. The user then has to adjust his/her own position to wash each portion of the body, which is inconvenient for the user. In addition, the engaging arms may not be strong enough to hold the showerhead, so the engaging arms may be broken or damaged when being used for a long period of time.

SUMMARY OF THE INVENTION

The technical problem to be solved in the present invention: (1) there is only a fixed angle for the showerhead to be hung on the wall, and the angle of water output from the showerhead cannot be adjusted. The user then has to adjust his/her own position to wash each portion of the body, which is inconvenient for the user; and (2) the engaging arms of conventional showerhead bases may not be strong enough to hold the showerhead, so the engaging arms may be broken or damaged when being used for a long period of time.

The present invention provides a structure for hanging a showerhead including a fixed base, and one end of the fixed base has a mounting surface and the other end has a conjugating portion. The structure also has a supporting unit having two clamping arms and two conjugating arms, wherein one side of the clamping arms has a wedging surface that has two conjugating recessed arcs with an inclined angle corresponding to the mounting surface of the fixed base. The inclined angle of one recessed arc is smaller than the other recessed arc. The wedging surface has two conjugating surfaces extending from one end thereof, and the other end of the clamping arms has an engaging surface. The conjugating arms are a shell body, one side of which has a conjugating opening for conjugating the engaging surface of the clamping arms. One end of the conjugating opening has a connecting end extending therefrom, and the connecting end engages with the conjugating portion of the fixed base to form a structure for hanging the showerhead.

Comparing with conventional techniques, the present invention has the following advantages:

(a) when the user hangs the showerhead at the hanging space or the other hanging space, the angle for the showerhead to move up and down can be adjusted with different inclined angles of the conjugating recessed arcs to further adjust the water shower angle of the showerhead; and (b) since the engaging surface of the clamping arms of the supporting unit has the reinforced frame and the reinforced rib, and the conjugating opening of the conjugating arms has reinforced rib pieces to strengthen the structure of the supporting unit and reduce processing materials of the supporting unit to reduce manufacturing costs.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
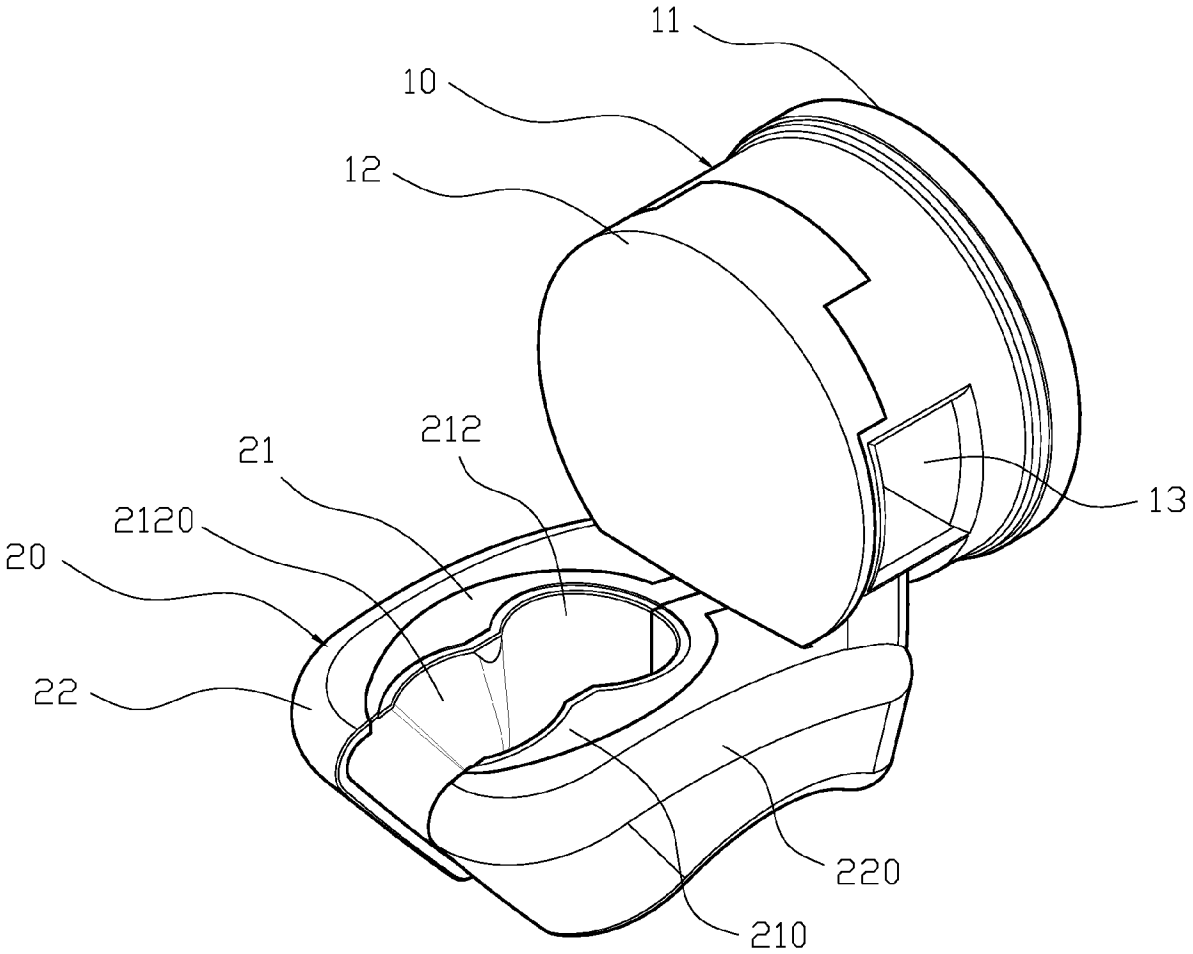
FIG. 1 illustrates a three-dimensional assembled view in the present invention.
Figure 2:
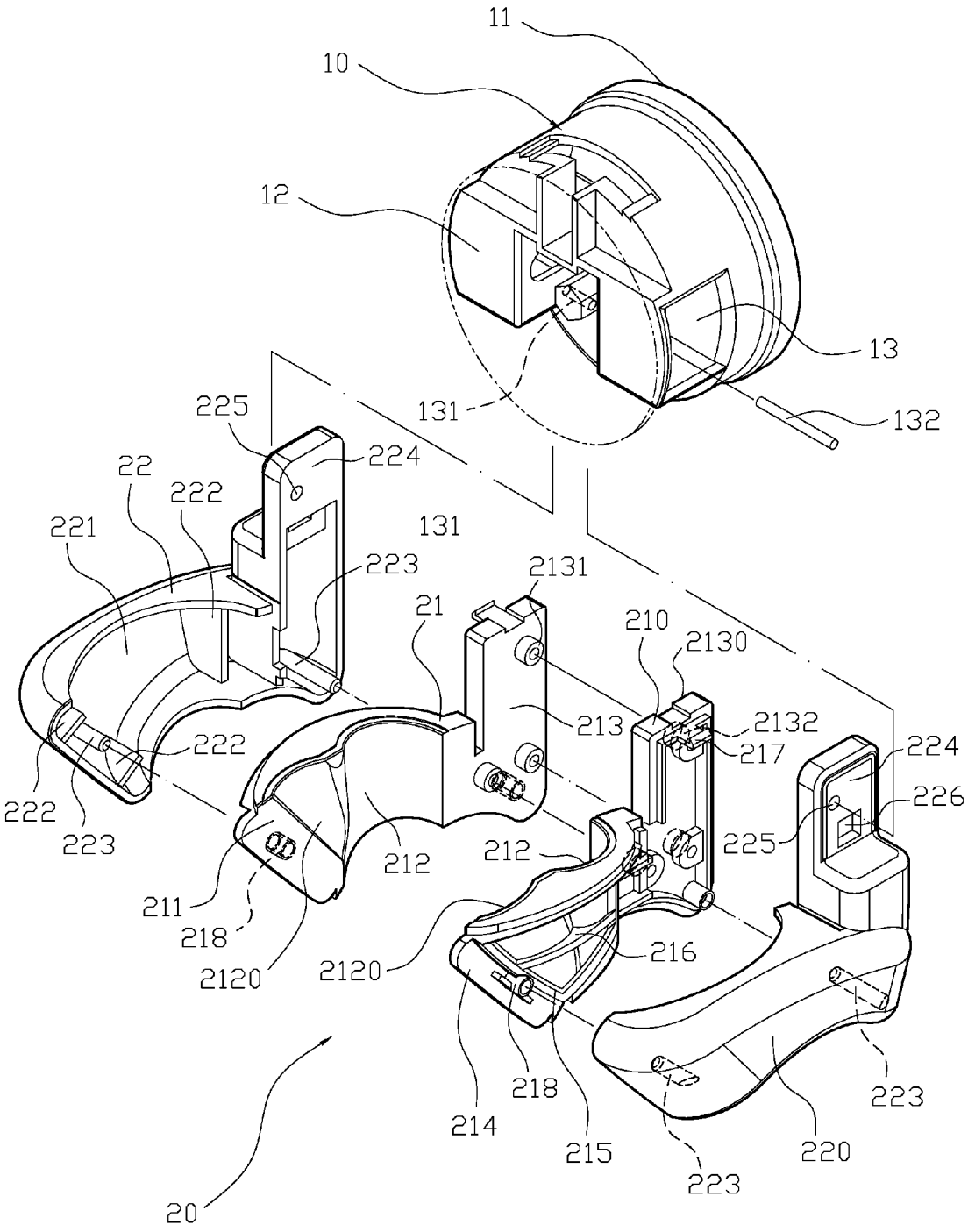
FIG. 2 illustrates a three-dimensional exploded view in the present invention.

In order to further understand the goal, characteristics and effect of the present invention, a number of embodiments along with the drawings are illustrated as following:

Referring to FIGS. 1 to 2, a structure for hanging a showerhead includes a fixed base (10) and a supporting unit (20), wherein one end of the fixed base (10) has a mounting surface (11) which is used to connect to a wall surface, and the other end has a conjugating portion (12) that has a wedging slot (13) on both sides of the conjugating portion (12). The wedging slot (13) has a through hole (131) and a conjugating unit (132) is passing therethrough. The supporting unit (20) has two clamping arms (21) (210) and two conjugating arms (22) (220), wherein one side of the clamping arms (21) (210) has a wedging surface (211) that has two conjugating recessed arcs (212) (2120) with an inclined angle (not shown), and the inclined angle is corresponding to the mounting surface (11)

of the fixed base (10). The inclined angle of one recessed arc (212) is smaller than the other recessed arc (2120), and the wedging surface (211) has two conjugating surfaces (213) (2130) extending from one end thereof. One conjugating surface (213) is protruding and has a plurality of protruding posts (2131), and the other conjugating surface (2130) recessedly forms a plurality of recessed slots (2132) to engage the protruding posts (2131). The other side of the clamping arms (21) (210) has an engaging surface (214) that has a reinforced frame (215) protrudingly formed corresponding to conjugating recessed arcs (212) (2120). A reinforced rib (216) is protrudingly formed in the reinforced frame (215), and a wedge (217) and plurality of connecting posts (218) are formed on both sides of the reinforced frame (215). The conjugating arms (22) (220) are a shell body, one side of which has a conjugating opening (221) for conjugating the engaging surface (214) of the clamping arms (21) (210). A plurality of reinforced rib pieces (222) and wedging posts (223) are protrudingly formed at the conjugating opening (221), wherein the wedging posts (223) are engaged with the connecting posts (218) of the clamping arms (21) (210). One end of the conjugating opening (221) has a connecting end (224) extending therefrom, and one side of the connecting end (224) has a through opening (225) for the conjugating unit (132) of the fixed base (10) to pass through. A wedging hole (226) formed near the through opening (225) is used for the wedge (217) of the clamping arms (21) (210).

Figure 3:
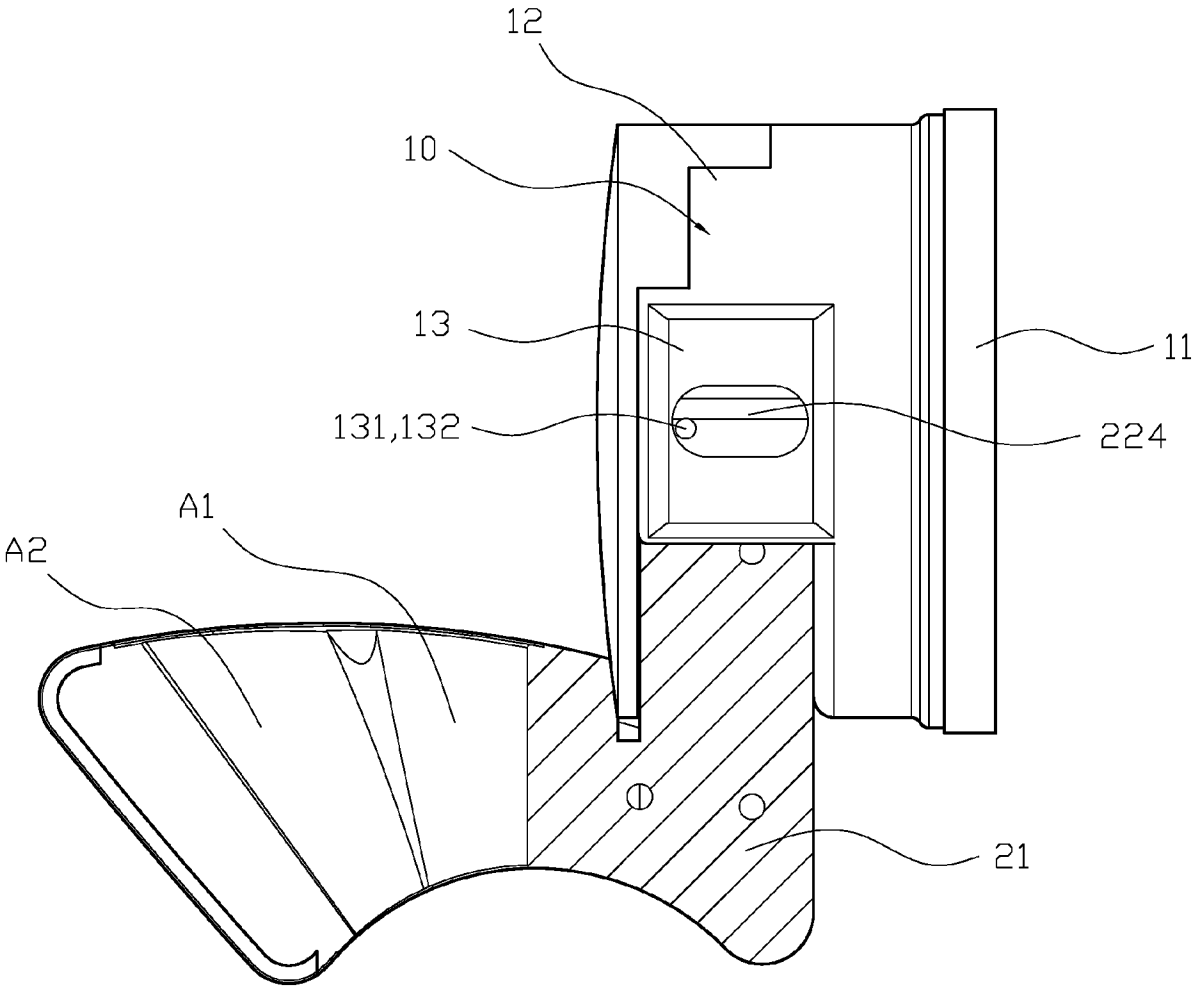
FIG. 3 illustrates a schematic sectional view in the present invention.

According to FIGS. 2 and 3 regarding the structure of the present invention, the engaging surface (214) of the clamping arms (21) (210) conjugates with the conjugating opening (221) of the conjugating arms (22) (220), and the wedge (217) of the engaging surface (214) and the connecting posts (218) engage with the wedging hole (226) of the conjugating opening (221) and wedging posts (223). Furthermore, one conjugating surface (213) of the clamping arms (21) (210) faces the other (2130), and the protruding posts (2131) of the conjugating surface (213) engage with the recessed slots (2132) of the other conjugating surface (2130) to complete the assembly of the supporting unit (20). So, the conjugating recessed arcs (212) (2120) of the clamping arms (21) (210) are disposed spacedly to form two hanging spaces (A1) (A2), respectively. Also, the through opening (225) of the conjugating arms (22) (220) in the supporting unit (20) faces the through hole (131) of the fixed base (10), and the conjugating unit (132) is used to pass through to secure the position and complete the assembly process.

Figure 4:
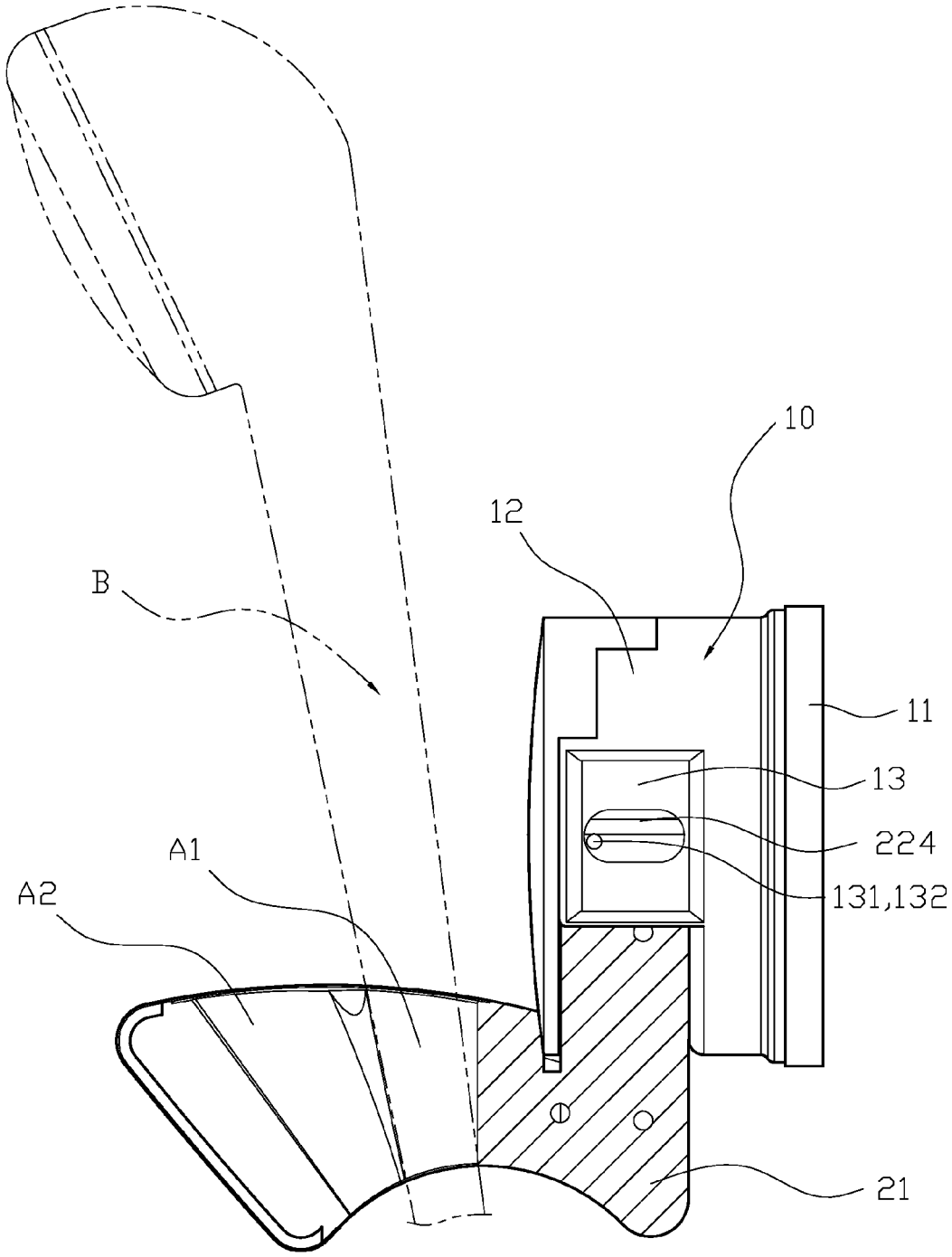
FIG. 4 illustrates a schematic view of one practical usage of the present invention.
Figure 5:
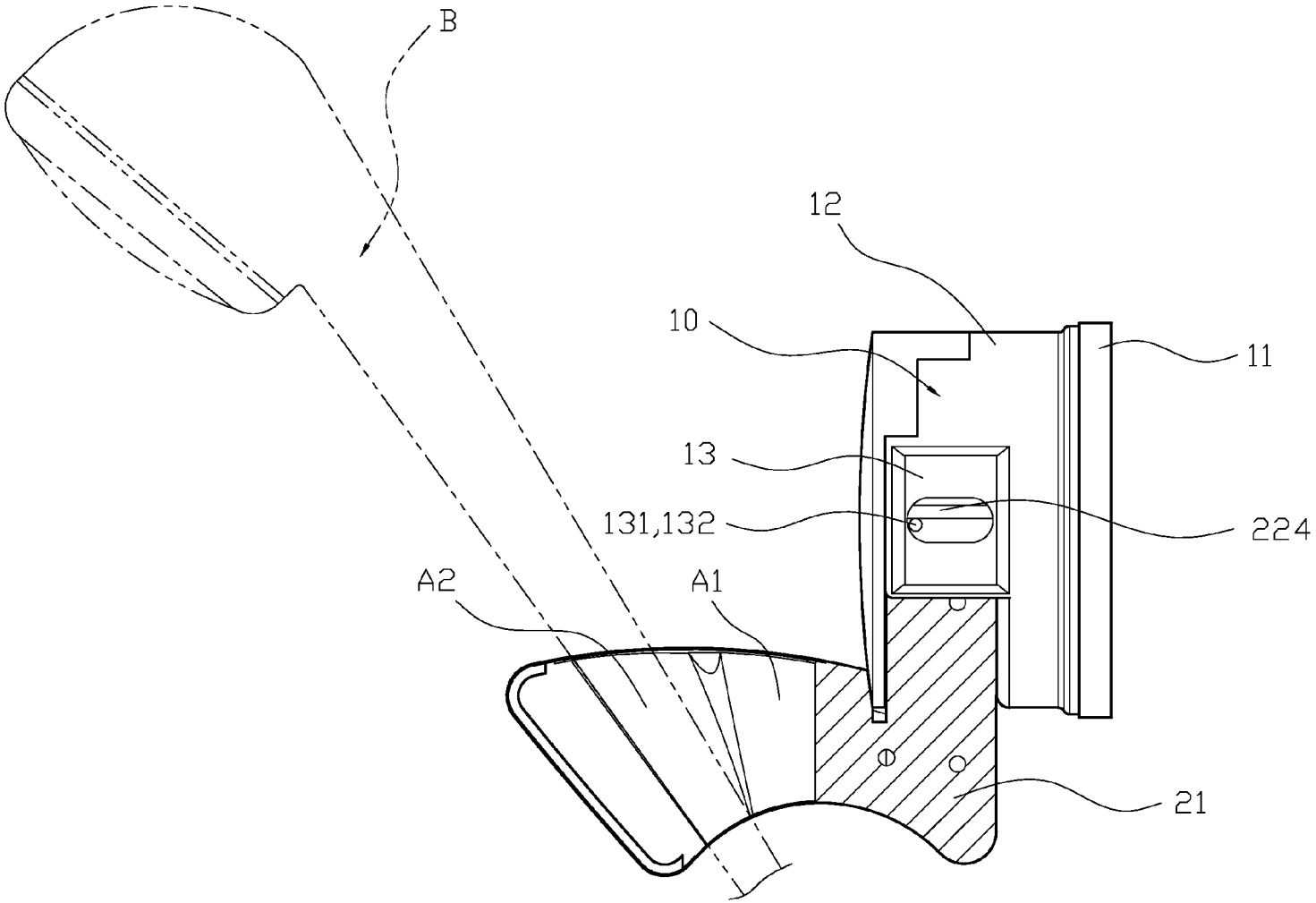
FIG. 5 illustrates a schematic view of another practical usage of the present invention.

Referring to FIGS. 2 and 3 with respect to practical usage of the claimed structure, when the user hangs the showerhead (B) at the hanging space (A1) or the other hanging space (A2), the angle for the showerhead (B) to move up and down can be adjusted with different inclined angles of the conjugating recessed arcs (212) (2120) to further adjust the water shower angle of the showerhead (B) (see FIGS. 4 and 5). On the other hand, since the engaging surface (214) of the clamping arms (21) (210) of the supporting unit (20) has the reinforced frame (215) and the reinforced rib (216), and the conjugating opening (221) of the conjugating arms (22) (220) has reinforced rib pieces (222) to strengthen the structure of the supporting unit (20) and reduce processing materials of the supporting unit (20) to reduce manufacturing costs.

Figure 6:
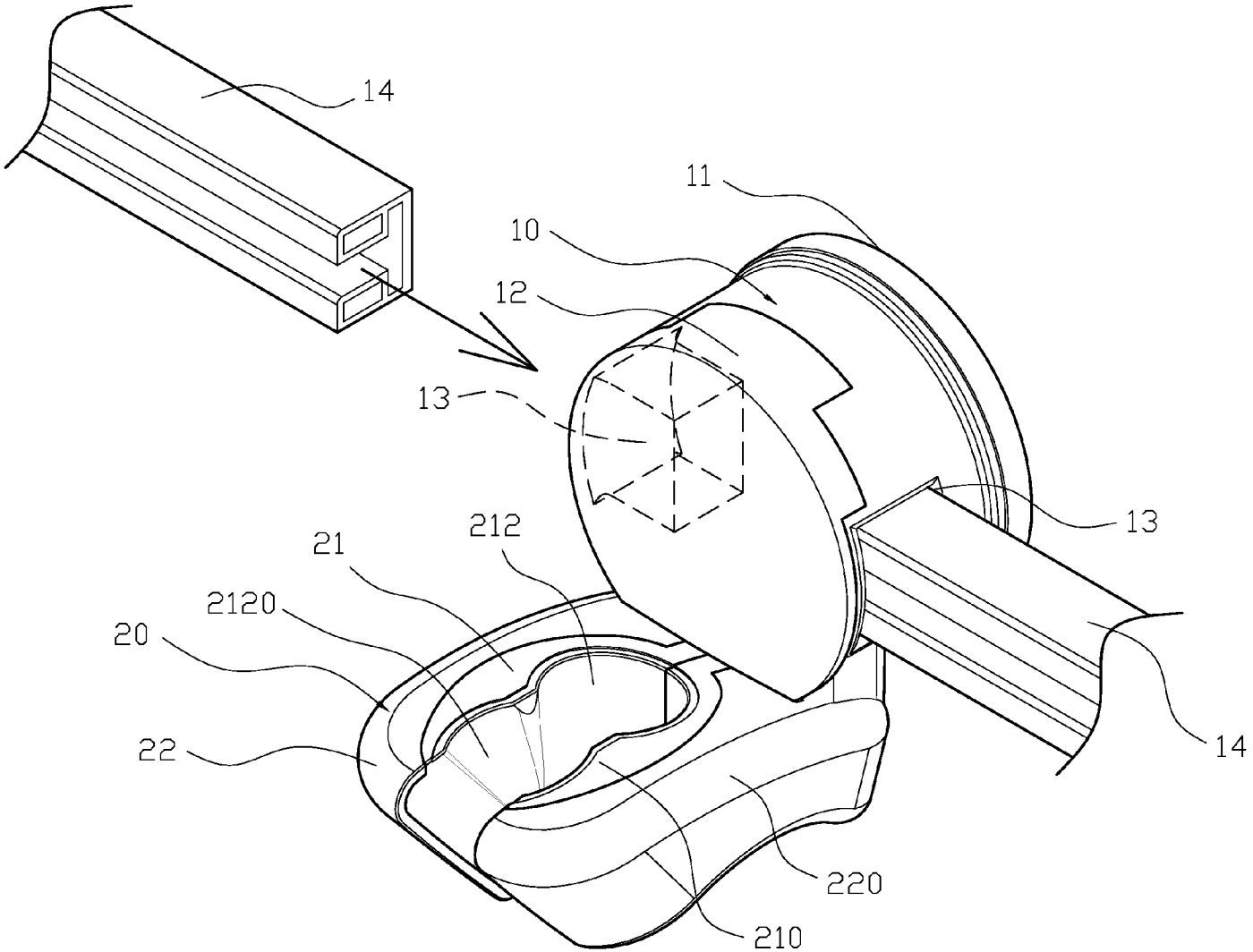
FIG. 6 illustrates another embodiment of the present invention.

In an alternative embodiment, as shown in FIG. 6, the wedging slot (13) of the fixed base (10) can be connected with an extension rod (14) to hang items on the body of the extension rod (14) to improve the convenience of the present invention.

According to the structure shown in the embodiments, the present invention has the following advantages: (a) when the user hangs the showerhead (B) at the hanging space (A1) or the other hanging space (A2), the angle for the showerhead (B) to move up and down can be adjusted with different inclined angles of the conjugating recessed arcs (212) (2120) to further adjust the water shower angle of the showerhead (B); and (b) since the engaging surface (214) of the clamping arms (21) (210) of the supporting unit (20) has the reinforced frame (215) and the reinforced rib (216), and the conjugating opening (221) of the conjugating arms (22) (220) has reinforced rib pieces (222) to strengthen the structure of the supporting unit (20) and reduce processing materials of the supporting unit (20) to reduce manufacturing costs.

Having described the invention by the description and illustrations above, it should be understood that these are exemplary of the invention and are not to be considered as limiting. Accordingly, the invention is not to be considered as limited by the foregoing description, but includes any equivalent

What is claimed is:

1. A structure to hang a showerhead comprising:

a fixed base, one end of which having a mounting surface and the other end having a conjugating portion;

a supporting unit having two clamping arms and two conjugating arms, wherein one side of the clamping arms has a wedging surface that has two conjugating recessed arcs with an inclined angle corresponding to the mounting surface of the fixed base, and the inclined angle of one recessed arc is smaller than the other recessed arc, wherein a conjugating surface extends from one end of the wedging surface, and engages with the other conjugating surface of the other clamping arm, and an engaging surface is formed on the other side of the clamping arm, wherein the conjugating arms are of a shell body, one side of which has a conjugating opening for conjugating the engaging surface of the clamping arms, and one end of the conjugating opening has a connecting end extending therefrom, and the connecting end engages with the conjugating portion of the fixed base.

2. The structure to hang a showerhead of claim 1, wherein a reinforced frame is protrudingly formed at the engaging surface of the clamping arm corresponding to the conjugating recessed arc.

3. The structure to hang a showerhead of claim 1, wherein a reinforced rib is protrudingly formed at the engaging surface of the clamping arm corresponding to the conjugating recessed arc.

4. The structure to hang a showerhead of claim 1, wherein a plurality of reinforced rib pieces are protrudingly formed at the conjugating opening of the conjugating arm.

5. The structure to hang a showerhead of claim 1, wherein a wedging slot is recessedly form on both sides of the conjugating portion, and the wedging slot is allowed to connect to a extension rod.

* * * * *